United States Patent [19]

Kohnhauser et al.

[11] Patent Number: 4,773,251

[45] Date of Patent: Sep. 27, 1988

[54] EXTRUSION PRESS DIE

[75] Inventors: Alexander Kohnhauser; Kurt Haberfellner, both of Kapfenberg, Austria

[73] Assignee: Vereinigte Edelstahlwerke Aktiengesellschaft, Vienna, Austria

[21] Appl. No.: 26,450

[22] Filed: Mar. 17, 1987

[30] Foreign Application Priority Data

Mar. 18, 1986 [AT] Austria ..... 720/86

[51] Int. Cl.[4] ..... B21C 25/02

[52] U.S. Cl. ..... 72/467

[58] Field of Search ..... 72/467, 253.1; 76/107 A, 107 R; 228/161, 160

[56] References Cited

U.S. PATENT DOCUMENTS

| | | | |
|---|---|---|---|
| 2,042,012 | 5/1936 | Lumsden | 76/107 R |
| 2,058,110 | 9/1936 | Schroter et al. | 72/467 |
| 2,236,288 | 3/1941 | Engle et al. | 76/107 A |
| 3,112,828 | 12/1963 | Zipf | 72/467 |
| 3,364,718 | 1/1968 | Green | 72/253.1 |
| 3,832,167 | 8/1974 | Shaw et al. | 72/467 |

*Primary Examiner*—Daniel C. Crane
*Attorney, Agent, or Firm*—Holman & Stern

[57] ABSTRACT

A metallic die for extruding a metal material, preferably a material of Al or alloys thereof, and/or of nonferrous metals, particularly Cu or alloys thereof, has an essentially flat, disc-shaped die body with at least one aperture, and a second aperture segment which adjoins a first aperture segment. The first aperture segment corresponds to and gives the final form to the desired cross section of the extrusion, and the second aperture segment is at least coincident with the first in its extent transversely to the pressing direction, and is preferably everywhere wider than the first aperture segment. The die body has at least two die parts which adjoin each other at a surface which is preferably generally flat and extends transversely to the press direction. The die parts are of different metallic materials, the first die part having an aperture segment which at least covers the cross section of the entire opening which accomplishes the final forming, and the second die part has an aperture segment which generally adjoins that of the first and preferably has a release clearance. The die part having the aperture segment which produces the final form is of a material with high wear-resistance and hot strength, preferably a high alloy hot-work steel, a high speed tool steel, or a superalloy, particularly an alloy based on Co—, Ni—, or Mo, and the die part with the release clearance is comprised of a tough, nonductile, heat-resistant steel, preferably a medium alloy hot-work steel, and wherein the die parts are bonded together over the surface (23) by a pure metal-to-metal bond of the type of the metals themselves to form a single unit die body.

4 Claims, 1 Drawing Sheet

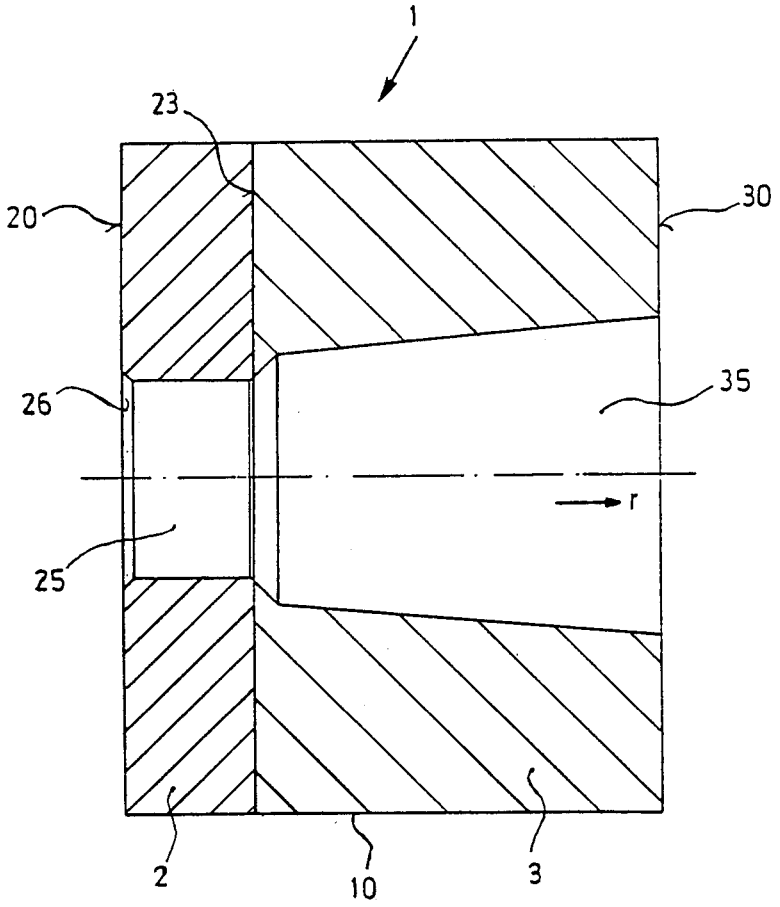
1
23
20
30
26
35
r
25
2
10
3

EXTRUSION PRESS DIE

BACKGROUND OF THE INVENTION

The present invention relates to a metallic die for extruding a metal material, preferably a material comprised of Al or alloys thereof, and/or comprised of nonferrous metals, particularly Cu or alloys thereof, having an essentially flat, disc-shaped die body with at least one aperture, wherewith a second aperture segment adjoins (in the pressing direction) a first aperture segment, which first aperture segment corresponds to and gives the final form to the desired cross section of the extrusion, wherewith the second aperture segment is at least coincident with the first in its extent transversely to the pressing direction, and is preferably everywhere wider than said first aperture segment.

In general the extrusion procedure for metals is as follows: A billet or the like of the metal to be extruded is brought to its deformation temperature, and high press pressure is applied whereby one or more continuous metal extrusions are formed through the die opening or openings which gives the desired cross sectional shape to the extrusion. An extruding apparatus generally has a billet chamber with walls which resist heat and high pressure, in which the heated metal billet is inserted. The required extrusion pressure is then applied to the billet by means of, e.g. a press plunger which is slidable in the billet chamber. The end face of the billet chamber is closed off (except for the die aperture) by the die. The die may be held in position with respect to the lateral direction by means of a die holder, e.g. of a type which surrounds the die on the periphery thereof; and the die may be held in position with respect to the pressing direction by means of a pressure plate disposed in the tool holder. In the direction of the extruding movement, the die, which is exposed to high mechanical stresses, is supported on its side facing away from the billet chamber by means of a die support device, which device in turn is ordinarily supported against the aforementioned pressure plate of the tool holder.

For extrusion of nonferrous metals and their alloys, e.g. Al or Cu or alloys of these, dies are used which have die bodies which are essentially flat and disc-shaped, wherewith the shape of the forming aperture(s) is such that a first aperture segment, into which the metal being extruded first enters, has a cross sectional surface area and shape which essentially coincides with the final profile of the extrusion being produced. As one proceeds in the direction of metal movement, this final-forming aperture segment undergoes a transition to a generally wider segment, which second segment has at least the same cross sectional area as the first segment, but which generally is wider than the first in all directions transverse to the extrusion direction, which widening may be abrupt or gradual (in the nature of undercutting). The actual transition locus between the final forming first aperture segment and the subsequent, wider second aperture segment is generally non-smooth, i.e. it has a relatively sharp edge. In dies for extruding aluminum and copper and their alloys, there may not be an approximately conical inlet segment on the inlet side of the final-forming aperture segment, or such conical inlet segment may be very short.

The materials used for the described extrusion dies according to the state of the art, which materials are understood to be different depending on the nonferrous metal to be extruded, are comprised of specially treated round steel bar (hot-work steel) sawed into discs, which steel may be of the kinds designated as German steel Code Nos. 1.2343, 1.2344, or 1.2567, in a hardened and annealed, and possibly subsequently nitrided state. Such dies for Al are suitable for operating temperatures in the 450° C. range, which temperatures occur at (heretofore) ordinary extrusion rates. For extrusion of Cu and its alloys, where the temperature of the heated billet is higher (750°-1040° C.), the dies ordinarily used are mounted dies of high alloy hot-work steel, e.g. of kinds designated as German steel Code Nos. 1.2581, 1.2678, 1.2886, or 1.2888, or of precipitation hardened Cu−, Mo−, or Ni steels, e.g. No. 1.6354, or of specialty alloys, particularly specialty alloys based on Co, Ni, or Mo.

In order to improve the economic efficiency of the extrusion process one must have available die materials which can withstand higher press speeds than formerly, which speeds lead to higher temperatures at the aperture and in the die. At the same time, it should be possible to employ dies with complicated aperture cross sectional shapes, and to increase economic efficiency by providing a plurality of apertures.

Temperatures which occur at the aperture are 600°-640° C., for example, when the high press forces are employed (in the range of 7000 metric tons which are required for these higher press speeds in the case of aluminum with a billet temperature of 450° C. Under these conditions, the rest of the die body is heated to about 550°-580° C., and the tool holder is in the neighborhood of 200° C. In order to be able to withstand the substantially increased stresses with regard to mechanical load, temperature, and frictional wear occasioned by the increased press pressure and speed, it was sought to fabricate the extrusion dies from metallic materials having elevated hot strength and resistance to frictional wear while hot, achieved by elevated levels of alloying components. However, this increasing of the alloy level has a detrimental effect on hot toughness, which is a serious drawback in view of the increased mechanical and thermal stressing and the condition that it be possible to produce profiles with complex shapes. When high alloy steels, e.g. high speed tool steels, have been used for dies for extruding Al and its alloys, or when Co−, Mo−, or Ni− based alloys have been used for dies for extruding Cu and its alloys, where (for the Al or the Cu extrusion) the apertures were of complex shape or of high cross sectional area or were several in number, it has been found that the usefulness of these hard die materials is limited because thermal and fire cracking occurs, so that it is practically inevitable that the tools will have to be reprocessed mechanically and thermally after a short service life. This situation is costly and engenders increased downtime. Moreover, the specialty alloys based on Co, Mo, or Ni, as used for dies for extruding bronze, brass, and copper, have a tendency to contract during use, whereby after a certain operating period they tend to loosen in their mounts.

The underlying problem of the present invention is to devise extrusion dies which do not have the described drawbacks despite the use of elevated press speeds, and which in particular achieve high extrusion speeds for the abovementioned metals and alloys, while having long service life, no appreciable risk of crack formation in the die even when extruding with die apertures of complex shape, and no appreciable contraction of the die.

SUMMARY OF THE INVENTION

The present invention comprises a metallic die for press-extrusion of metallic materials, preferably nonferrous metals, e.g. Al and Cu and alloys of these, which die has a generally disc-shaped die body with at least one aperture, wherewith a second aperture segment adjoins (in the direction of movement of the metal) a first aperture segment, which first aperture segment corresponds to and gives the final form to the desired cross section of the extrusion, wherewith the second aperture segment is at least coincident with the first in its extent transversely to the pressing direction, and is preferably everywhere wider than said first aperture segment; which die is characterized in that the die body is comprised of at least two die parts which adjoin each other at a surface which surface is preferably generally flat and extends transversely to the press direction, wherewith said die parts are of different metallic materials, wherewith the first die part has an aperture segment which at least covers the cross section of the entire opening which accomplishes the final forming, and the second die part has an aperture which generally adjoins that of the first and preferably has a release clearance, wherewith the die part having the aperture segment which produces the final form is comprised of a material with high wear-resistance and hot strength, preferably a high alloy hot-work steel, a high speed tool steel, a precipitation hardened steel, or a superalloy, particularly an alloy based on Co−, Ni−, or Mo, and the die part with the release clearance is comprised of a tough, nonductile, heat-resistant steel, preferably a medium alloy hot-work steel, and wherein the said two die parts are bonded together over the said surface by a pure metal-to-metal bond of the type of the metals themselves i.e., not brazed, soldered, or the like, to form a single-unit die body. With the novel die comprised of bonded parts, the former limitation to fairly simple die apertures no longer applies. It has also been found that substantially larger die apertures can be used, because the top layer material which contacts the heated metal, which top layer material has less hot strength but more hot wear resistance, is completely supported by the heat-resistant underlayer material. In addition, a plurality of apertures of complex shape can be provided in the die body, without resulting problems. The laminated structure with the metal-to-metal bond itself contributes improved mechanical strength and stability transversely to the bonding surface. Thus, the novel, relatively inexpensively fabricated laminated dies achieve a combination of properties—the necessary high-temperature wear resistance for the aperture which produces the final form (which property is supplied by, e.g., high alloy hotwork steels and/or high alloy high speed tool steels), and high hot toughness and good high-temperature mechanical strength (supplied by die materials heretofore used and proved effective for dies). Advantageously, the materials used for the wear-resistant die part have HRC values >43, preferably >50. Favorable values of the strength of the supporting die part are >700 N/mm$^2$, preferably 1000 N/mm$^2$. The fracture energy may [sic] be >150 J/cm$^2$. As a result of the integral metal-to-metal bond without dissimilar metal between the die parts, and the mutual support function of said bond, there is practically no occurrence of the above-described hot cracking and fire cracking in the highly heat-resistant and the wear-resistant material, and a press extrusion die is obtained which has high service life at a much increased production rate. The abovementioned problems connected with shrinkage of a mechanically held die do not occur. Further, the laminated structure results in substantial savings of the costly hot-wear-resistant material.

BRIEF DESCRIPTION OF THE DRAWINGS

The drawing is a sectional side view of a two-part die, according to the present invention.

DETAILED DESCRIPTION OF THE INVENTION

The novel extrusion die may be fabricated according to one of the known laminated or bonded steel fabrication methods, e.g., forge bonding, explosive bonding, or roll bonding, employing, e.g., hot isostatic presses or the like, which latter i.e.; isostatic presses; may additionally be followed by metal forming operations such as, e.g., forging or rolling. Inventive dies may be economically fabricated by rolling, even with the use of materials which are difficult to bond together by other techniques. A homogeneous, strong metallic bond can be achieved at the bonding surface of the two die parts, which provides the advantage that both parts have a grain direction which is essentially transverse to the press direction. With this general fabrication method, the customary technique is to take two metal plates of different metallic materials (which are to be joined to form a flat laminate), and to clean said plates and align them face to face, then weld them hermetically at the edges, and to roll them at a temperature near the solidus temperature (e.g. about 1150° C.), with a deformation factor of 2 to 2.5, wherewith in adjusting the process parameters one takes into account the desired thickness ratio of the two die parts and the differing deformation resistances of the two materials.

It has been discovered in connection with the invention that the thickness ratio of the two die parts which are to be integrally bonded together (the ratio of thickness of the steel having hot strength and hot wear resistance to the thickness of the steel having hot toughness) should not be >1:1; otherwise, a tendency to crack and/or shrink may be present. It is particularly preferred if the die part having the aperture segment which generally produces the final form of the extrusion has a thickness which is approximately 45% to 20%, and preferably approximately 33% to 25%, of the thickness of the die body. Thus, the supporting die part is the thicker, which ensures sufficient hot toughness to prevent a tendency of the wear-resistant material to crack in the corresponding i.e., forming die part, and the high mechanical stresses, particularly in the axial direction, which stresses occur due to the high press pressure, can be borne particularly well. These thickness ratios of the die parts are particularly advantageous in extrusion presses for Al and Cu and their alloys. One need have only short final-forming aperture segments when extruding these materials. The apertures, and the release clearance in the supporting die part, can be advantageously produced by means of wire spark erosion, which enables high accuracy.

The following exemplary combinations of materials have proven particularly advantageous in practice for the inventive dies however the listing of these does not limit the scope of the present invention. For the die part having the customarily expanding aperture segment, the following medium alloy hot-work steels are suitable, for example: those kinds of steels designated as German Steel Code Nos. 1.2343, 1.2344, and 1.2567. These materials have been used heretofore for ordinary Al-extrusion dies comprised of a single material. The designation numbers referred to hereinafter are German Steel Code numbers. For the die part having the aperture part which produces the final form of the extrusion, one may advantageously use, e.g., the following, with the choice depending on the temperature required for the extrusion: high alloy hot-work steels (e.g. No. 1.2886), high speed tool steels (e.g. No. 1.3343 or 1.3243), precipitation hardened steels (e.g. No. 1.6354), or hot strength specialty alloys (e.g. No. 2.4979 or 2.4686). The Table shown on the following page, contains descriptions of the specific materials mentioned, which materials can be used advantageously for the inventive bonded extrusion dies.

The numbers in the left column are the German steel Code numbers.

The following Examples will further illustrate the invention:

EXAMPLE 1

For dies for press extrusion of Al profiles, rollbonded laminated steel was used, in the combination of No. 1.2344 hot-work steel with No. 1.3343 high speed tool steel, with the latter representing 4 mm out of the total 20 mm thickness. The fabrication was by roll plating, which yielded a uniform lit., "homogeneous" metal bond. Following soft annealing of the laminated plate, discs of diameter 180 mm were cut out, and were premachined on the exterior surface i.e., circumference and the flat sides. The starting holes for the wire spark erosion were drilled. Then the workpieces were heat treated in a salt bath at 1150° C., followed by quenching in a bath at 520°-540° C. The workpieces were then tempered twice at 620° C. to bring the hardness of the high speed tool steel to 51 HRC. The final fabrication was then carried out, in which 10 approximately rectangular U-profile apertures 2.5 mm wide i.e., thick were cut in a circular array, by means of wire spark erosion. To relax stresses after the spark erosion operation, annealing at 580° C. was carried out. As is usual under the state of the art, salt bath nitriding was also carried out, with immersion time 10 min. The die was installed in a 16 MN press for AlMgSiO.5. The service life was about 4 times as long as that of dies fabricated from a single plate of No. 1.2344 nitrided steel.

TABLE

| German Steel Code Numbers | C | Si | Mn | P | S | Co | Cr | Mo | V | W | Ni |
|---|---|---|---|---|---|---|---|---|---|---|---|
| 1.2343 | 0,36–42 | 0,9–1,2 | 0,3–0,5 | 0,03 | 0,03 | — | 4,8–5,5 | 1,1–1,4 | 0,25–50 | — | |
| 1.2344 | 37–42 | " | " | — | — | — | — | 1,2–1,5 | 0,9–1,1 | — | |
| 1.2564 | 0,25–0,35 | 0,15–0,30 | 0,2–0,4 | 0,035 | 0,035 | — | 2,2–2,5 | — | 0,5–0,7 | 4,0–4,5 | |
| 1.2581 | 0,25–0,35 | 0,15–30 | 0,2–0,4 | 0,035 | 0,035 | — | 2,5–2,8 | — | 0,3–0,4 | 8–9 | |
| 1.2678 | 0,4–0,5 | 0,3–0,5 | 0,3–0,5 | 0,025 | 0,025 | — | 4–5 | 0,4–0,6 | 1,8–2,1 | 4–5 | |
| 1.2886 | 0,13–0,18 | 0,15–0,25 | 0,15–0,25 | — | — | 9,5–10,5 | 9,5–10,5 | 4,9–5,2 | 0,45–55 | — | |
| 1.2888 | 0,17–0,25 | 0,15–0,35 | 0,40–0,60 | 0,035 | 0,035 | 9,5–10,5 | 9,0–10,0 | 1,8–2,2 | — | 5,0–6,0 | |
| 1.3343 | 0,86–0,94 | ≦0,45 | ≦0,40 | 0,03 | 0,03 | — | 3,8–4,5 | 4,7–5,2 | 1,7–2,0 | 6,0–6,7 | |
| 1.3243 | 0,88–0,96 | 0,3–0,45 | 0,2–0,35 | 0,03 | 0,025 | 4,5–5,0 | 4,0–4,5 | 4,7–5,2 | 1,7–2,0 | 6,0–6,7 | |
| 2.4979 | 0,25–35 | ≦1,0 | ≦1,0 | 0,045 | 0,030 | Rest | 27,0–29,0 | 5,0–6,0 | — | — | 1,5–3,0 |
| 2.4668 | 0,03–0,08 | ≦0,35 | ≦0,35 | 0,015 | 0,015 | 1,0 | 17–21 | 2,8–3,3 | — | — | 50,0–55,0 |
| | | 0,002–0,006 B 0,1 Cu 4,75–5,5 Nb 0,65–1,15 Ti 0,4–0,8 Al | | | | | | | | | |
| 1.6354 | ≦0,03 | ≦0,1 | ≦0,1 | 0,025 | 0,025 | 8,5–9,5 | — | 5,0–5,5 | | | 18–19 |
| | | | ≦0,3 Cu 0,5–0,7 Ti 0,05–0,15 Al | | | | | | | | |

EXAMPLE 2

Laminated steel dies were fabricated by roll bonding, in the combination of a support material comprising C 0.40%, Cr 2.6%, Mo 2.6%, V 0.9%, Nb 0.3%, and B 0.005%, and a material having hot strength, comprising a cobalt-based alloy, No. 2.4979 (C 0.05%, Cr 0.27%, Mo 6.0%, Co 62.0%, and Fe 4.0%). The die was 35 mm thick overall, with the thickness of the wear-resistant (cobalt) die part being 10 mm.

After the roll bonding, 4 apertures each having a generally cross-shaped branched [sic] profile were cut into the roll-hardened workpieces. This was followed by heat treatment (hardening) at 700° C. for 10 hr in air, and final machining. The hardness of the highly wear-resistant die part was 372 HB, and that of the supporting part was 357 HB. The metallic bond was found to be particularly advantageous in that there was none of the usual loosening of the die from its mount which results due to shrinkage if the die body is comprised solely of the Co-based alloy; and no fire cracking was observed. The service life was about 2.5 times as long as that of one-piece flat dies fabricated from the Co-based alloy, when both were individually employed for extruding the described profiles from a Cu-based extrusion alloy at 840° C. and press force 16 MN.

The drawing represents a cross section along the axis through an inventive die 1 for Al or for Al with small amounts of alloying materials (e.g. Mn, Mg, and/or Si). The single unit die body 10 (same as 1) is comprised of two die parts (2, 3) metallically bonded together at a common surface 23 which is essentially parallel to the main surfaces (20, 30) of the die body. The direction of metal movement is indicated by arrow r. Die part 2 is comprised of a metal material having hot strength and high wear resistance, which material may be a steel. Die part 3 is comprised of a medium alloy steel having hot toughness. The entirety of the aperture segment 25 which accomplishes the final forming is disposed in the die part 2, as is a small portion of the discontinuously (sharp-edged) adjoining, strongly conically flaring initial segment of the exit aperture segment 35, which initial segment adjoins segment 25. Most of the aperture in die part 3 is represented by segment 35, which widens with progression in direction r. On the inlet edge of the first aperture segment 25 there is a very short inlet cone region 26. The thickness ratio of the two die parts 2 and 3 is 1:3.

What is claimed is:

1. A metallic die for extruding a metal material which die has an essentially disc-shaped die body with at least one aperture therethrough with said at least one aperture having a first aperture segment and a second aperture segment adjoining said first aperture segment, said first aperture segment corresponding to and giving the final form to the desired cross section of the extrusion, said second aperture segment being at least coincident with said first aperture segment in extent transversely to an extrusion pressing direction, said die body being comprised of first and second die parts which adjoin each other at a bonding surface therebetween, said bonding surface being generally flat and extending generally transversely to the pressing direction, the first die part having an aperture therein which at least extends over the cross section of the entire first aperture segment opening which accomplishes the final forming, said second die part having an aperture therein which generally adjoins that of said first die part and which is provided with a release clearance, said first die part being of a metallic material with high wear-resistance and hot strength selected from the group comprising a high alloy hot-work steel, a high speed tool steel, and a superalloy steel, said second die part being of a tough, nonductile heat-resistant steel of a composition different from the metallic material of said first die part, said first and second die parts being bonded together over said bonding surface by a substantially homogenous integral metal-to-metal bond of the metals forming said first and second die parts themselves to form a single unit laminated die body.

2. A die according to claim 1 wherein said first and second die parts have a grain direction which is generally transverse to the pressing direction.

3. A die according to claim 1 wherein said first and second die parts are bonded together by roll bonding, to form a pure metal-to-metal bond of the type of the metals themselves.

4. A die according to claim 1 wherein said first die part has a thickness which is 20% to 45% of the overall thickness of said die body.

* * * * *